US005118366A

United States Patent [19]

Shintaku

[11] Patent Number: 5,118,366

[45] Date of Patent: Jun. 2, 1992

[54] METHOD OF FLOATINGLY SUPPORTING A METALLIC STRIP

[75] Inventor: Yasuyuki Shintaku, Sennan, Japan

[73] Assignee: Chugai Ro Co., Ltd., Osaka, Japan

[21] Appl. No.: 610,964

[22] Filed: Nov. 9, 1990

[51] Int. Cl.[5] ..... C21D 1/34; C21D 9/63

[52] U.S. Cl. ..... 148/13; 266/111; 266/274; 148/605; 148/631; 148/711

[58] Field of Search ..... 148/13, 156, 157; 266/103, 111, 274; 432/8

[56] References Cited

U.S. PATENT DOCUMENTS 3,744,961 7/1973 Eguchi et al. ..... 266/111

FOREIGN PATENT DOCUMENTS 61-049368 10/1986 Japan ..... 148/156
63-250422 10/1988 Japan ..... 266/111
64-039327 2/1989 Japan ..... 148/156

*Primary Examiner*—R. Dean
*Assistant Examiner*—Margery S. Phipps
*Attorney, Agent, or Firm*—Wenderoth, Lind & Ponack

[57] ABSTRACT

Disclosed is a method of floatingly supporting a metallic strip in a direct firing type continuous heat treating furnace accommodating a plurality of floater nozzles. In this method, furnace gas is initially supplied to and pressurized by a plurality of multistage booster fans. The temperature of the furnace gas to be supplied to the booster fans is less than a critical temperature of the fans. When the temperature of the furnace gas is less than the temperature of the material of the strip, the temperature of the furnace gas is raised to a temperature near the material temperature in combustion chambers provided with respective direct firing type burners. The furnace gas is then supplied to the floater nozzles, the internal pressure of which is controlled prior to being jetted.

3 Claims, 1 Drawing Sheet

METHOD OF FLOATINGLY SUPPORTING A METALLIC STRIP

BACKGROUND OF THE INVENTION

1. Field of the Invention

The present invention relates to a method of floatingly supporting a metallic strip in a direct firing type continuous heat treating furnace.

2. Description of the Prior Art

When a horizontally transported metallic strip of, for example, stainless steel is subjected to an annealing treatment, an apparatus for horizontally supporting the metallic strip is required. In a conventional heat treatment of a relatively thin metallic strip of aluminum, copper, or the like, a non-contact supporting method is employed. The reason for this is that the treating temperature is approximately 800° C. and the material to be treated is relatively light.

In this method, furnace gas is circulated and supplied to floater nozzles disposed in a furnace using booster fans so that the metallic strip may be floatingly supported by the static pressure generated by pressurized gas from the nozzles. However, this method cannot be applied to a metallic strip of, for example, stainless steel. Since this kind of metallic strip is heavy and the treating temperature thereof is in the range of 1000°-1200° C., the metallic material of the booster fans must exhibit good resistance to high temperatures and the fans must rotate at a high speed. Such a material, however, is not available.

Accordingly, in a heat treatment of the metallic strip of stainless steel or the like, water-cooled support rolls of asbestos are generally employed as a support means.

In this heat treatment, however, the high temperature metallic strip is brought into direct contact with the support rolls, thereby occasionally causing the picking-up or dragging on the surface of the metallic strip or the damage of the rolls. Furthermore, since asbestos is restricted in its use, careful consideration has been given to the use of the floatingly supporting method in the case where a horizontally transported metallic strip of stainless steel or the like is subjected to a heat treatment.

In this method, since gas having a temperature greater than 900° C. must be pressurized to a high pressure, booster fans would have to exhibit good resistance to high temperature and rotate at a high speed. If metallic booster fans are used, the temperature of booster gas is limited to a temperature below 800° C. in view of the durability of the fans.

Furthermore, the pressure of the booster gas is limited to a pressure below 350 $mmH_2O$ converted at the normal temperature. In this connection, when gas having a density equivalent to that of air at 1000° C. is pressurized to 350 $mmH_2O$, the fans are required to have a capacity of 1470 $mmH_2O$ at the normal temperature. This value requires a fan speed of over 2000 rpm. Since no metals can withstand such severe conditions, the use of ceramic fans has been proposed. However, the ceramic fans exhibit low resistance to vibration, thermal impulse and internal temperature difference and are therefore unsatisfactory for practical applications.

It is, therefore, quite difficult to apply the floatingly supporting method to a treatment at a high temperature of 1000°-1200° C., such as an annealing treatment for stainless steel.

SUMMARY OF THE INVENTION

The present invention has been developed to substantially eliminate the above-described disadvantages.

It is accordingly an object of the present invention to provide a method of floatingly supporting a metallic strip in a direct firing type continuous heat treating furnace operating at a treating temperature over 800° C.

In accomplishing this and other objects, the method according to the present invention comprises the steps of:

pressurizing furnace gas by a plurality of multistage booster fans, with the furnace gas having a temperature less than the critical temperature of the fans;

raising, when the temperature of the furnace gas is less than the temperature of the material to be treated, the temperature of the furnace gas to a temperature near the material temperature in combustion chambers provided with respective direct firing type burners;

supplying the furnace gas to a plurality of floater nozzles accommodated in the furnace; and controlling the internal pressure of the floater nozzles.

In the above-described method according to the present invention, metallic booster fans can be used by limiting the temperature of the furnace gas to be supplied to the booster fans to a temperature below 800° C. Furthermore, the multistage booster fans can sufficiently pressurize the furnace gas to a desired pressure at a speed of 1200 rpm below the critical speed. In addition, since the pressurized gas is further heated in the combustion chambers to a temperature near the material temperature, the material to be treated is never cooled by the gas jetted from the floater nozzles.

BRIEF DESCRIPTION OF THE DRAWINGS

These and other objects and features of the present invention will become more apparent from the following description taken in conjunction with the preferred embodiment thereof with reference to the accompanying drawing, throughout which like parts are designated by like reference numerals, and wherein.

DETAILED DESCRIPTION OF THE PREFERRED EMBODIMENT

Figure 1:
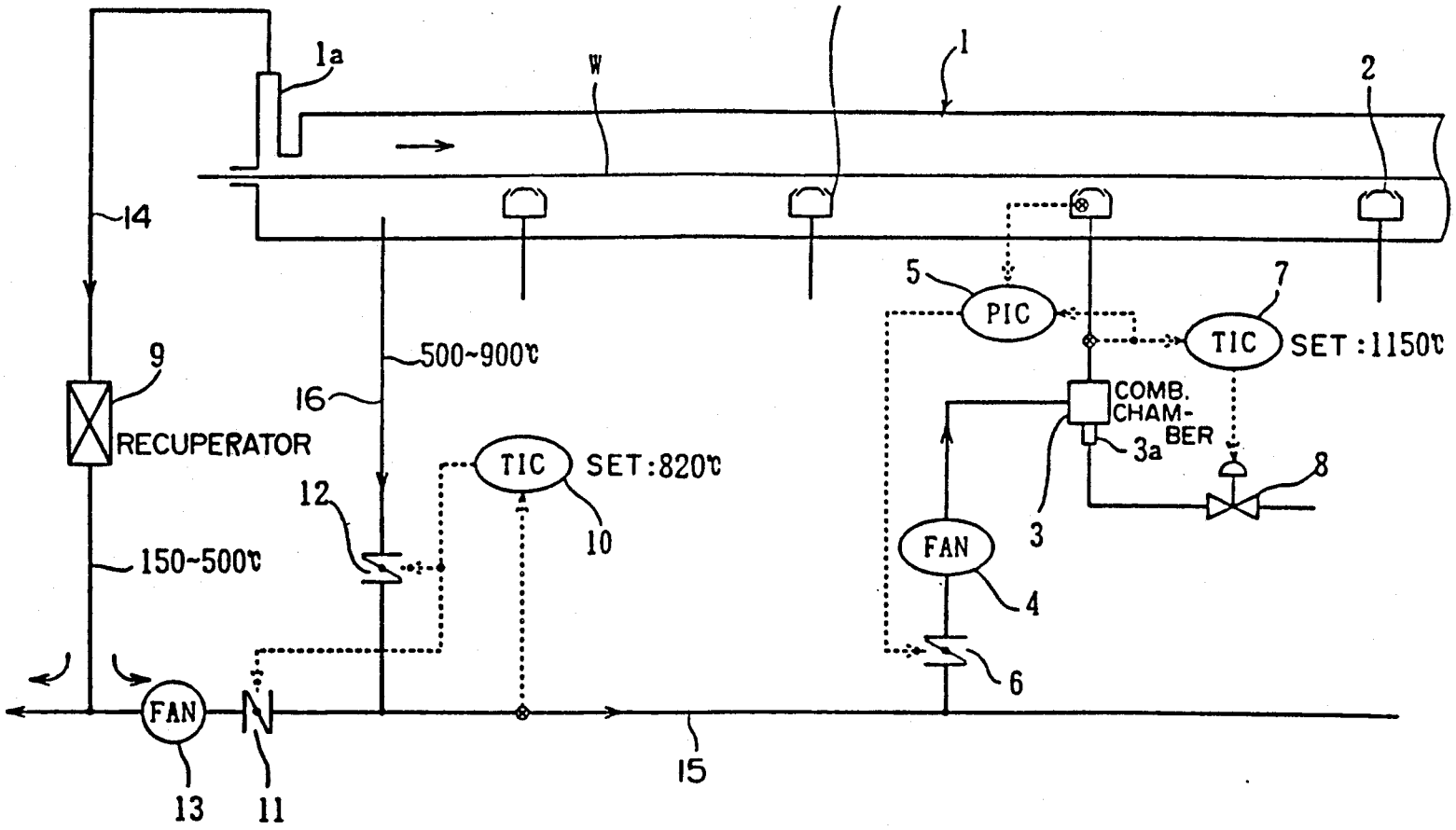
FIG. 1 is a schematic diagram of a direct firing type continuous heat treating furnace to which the method according to the present invention is applied.

There is schematically shown in FIG. 1 a direct firing type continuous heat treating furnace having a furnace body 1. A plurality of conventionally known floater nozzles 2 are placed at regular intervals of, for example, 6 m in the furnace body 1.

Each of the floater nozzles 2 placed in a high temperature zone communicates with a combustion chamber 3. The combustion chamber 3 is provided with a burner 3*a* and communicates with a metallic multistage booster fan 4 so that furnace gas pressurized to 350 $mmH_2O$ by the booster fan 4 may be introduced into the combustion chamber 3. The furnace gas is mixed with combustion gas from the burner 3*a* and is supplied to the floater nozzle 2.

The internal pressure of the floater nozzle 2 is compared with a preset pressure by a pressure regulator 5, which regulates the opening of a damper 6 disposed on the suction side of the booster fan 4 for the purpose of regulating the pressure of the pressurized gas jetted from the floater nozzle 2 to a desired pressure. In this embodiment, the control of the opening of the damper 6 is rectified by the temperature of the gas to be supplied to the floater nozzle 2.

The floater nozzle 2 placed in a high temperature zone is water-cooled to successively jet stable gas by preventing thermal distortion of the floater nozzle 2 itself.

The temperature of mixed gas from the combustion chamber 3 is compared with a preset temperature, for example 1150° C., by a temperature regulator 7, and the amount of fuel to be supplied to the burner 3*a* of the combustion chamber 3 is regulated by a regulating valve 8 so that the temperature of the mixed gas may be controlled.

An exhaust duct la is mounted on the inlet side of the furnace body 1 and a recuperator 9 is mounted in an exhaust gas return line 14 connected to the exhaust duct 1*a*. Furthermore, a recirculation fan 13 and a regulating valve 11 are mounted in series in a gas supply line 15, to which the exhaust gas return line 14 is connected. A zone formed on the inlet side of the furnace body 1 is connected to the gas supply line 15 through a furnace gas return line 16, in which a regulating valve 12 is mounted.

The temperature of exhaust gas discharged from the exhaust duct la is lowered to 150°-500° C. by the recuperator 9. Part of the exhaust gas from the recuperator 9 is led to the gas supply line 15 by the recirculation fan 13 and is mixed with part of the furnace gas fed to the gas supply line 15 through the furnace gas return line 16. The furnace gas fed to the gas supply line 15 has a temperature of 500°-900° C. A temperature regulator 10 controls the opening of both of the regulating valves 11 and 12 so that the temperature of the mixed gas may be less than 800° C., which is the critical temperature of the metallic booster fans 4.

When a metallic strip W of stainless steel having a thickness of 2.2 mm and a width of 1300 mm is floatingly supported by pressurized gas jetted from the floater nozzles 2, the gas is pressurized to, for example, 350 mm$H_2O$ at 800° C. by the booster fans 4 each having a capacity of 280 $m^3$/min, a 30 Kw motor and a speed of 1200 rpm. The pressurized gas is then heated to, for example, 1100° C. in the neighborhood of the temperature of the material in the combustion chambers 3, and is fed to the floater nozzles 2 to floatingly support the strip W.

In this embodiment, although the pressure of the furnace gas fed to the floater nozzles 2 is controlled by the opening of the dampers 6, it may be controlled by the speed of the booster fans 4.

As is clear from the above, the temperature of the furnace gas fed to the metallic multistage booster fans is less than the critical temperature of the fans, and the furnace gas is further heated so that the temperature thereof may be raised to near the temperature of the material. Accordingly, the metallic booster fans can be used as usual and the metallic strip is never cooled.

Furthermore, since the multistage booster fans can provide a high pressure at a low rotating speed and the pressure of the gas issuing from floater nozzles is controlled, a reliable floatation support can be maintained.

Accordingly, a relatively heavy material such as stainless steel can undergo an annealing treatment or the like at a high temperature in a gas-supported condition.

Although the present invention has been fully described by way of examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

What is claimed is:

1. A method of floatingly supporting a metallic strip being heat treated in a direct-firing continuous heat treating furnace, said method comprising the steps of:

directing gas from the furnace to a plurality of multistage booster fans and operating the fans so as to pressurize the gas, and regulating the temperature of the furnace gas introduced to the fans to a temperature less than a critical temperature which the fans could not withstand;

introducing the gas pressurized by the booster fans into combustion chambers provided with direct-firing burners, and controlling heating of the gas in the the combustion chambers to raise the temperature of the gas therein to a temperature near the temperature of the strip being treated in the furnace when the temperature of the gas is less than the temperature of the strip;

supplying the gas from the combustion chambers to floater nozzles within the furnace such that the floater nozzles jet the gas onto the metallic strip so as to floatingly support the strip; and controlling the pressure of the gas within the floater nozzles.

2. A method as claimed in claim 1, wherein the step of controlling the pressure of the gas comprises controlling the degree of opening of a plurality of dampers communicating with the floater nozzles.

3. A method as claimed in claim 1, wherein the step of controlling the pressure of the gas comprises controlling the speed of the booster fans.

* * * * *